United States Patent [19]

Sparrow et al.

[11] Patent Number: 4,788,753

[45] Date of Patent: Dec. 6, 1988

[54] EXPANSION COMPENSATING TWO PIECE BUTTON

[75] Inventors: Timothy H. Sparrow, Harrodsburg; Richard L. Harlow, Lexington, both of Ky.

[73] Assignee: Universal Fasteners Inc., Lawrenceburg, Ky.

[21] Appl. No.: 102,553

[22] Filed: Sep. 29, 1987

[51] Int. Cl.[4] ..... A44B 1/16

[52] U.S. Cl. ..... 24/113 MP; 24/92

[58] Field of Search ..... 24/90 HA, 92, 113 MP, 24/588; 40/315; 29/715

[56] References Cited

U.S. PATENT DOCUMENTS

| | | | |
|---|---|---|---|
| 2,016,241 | 10/1935 | Clark et al. | 24/113 MP |
| 2,247,522 | 7/1941 | Purinton | 40/315 |
| 2,254,417 | 9/1941 | Carley | 24/113 MP |
| 2,332,578 | 10/1943 | Kaynor et al. | 40/315 |
| 2,385,467 | 9/1945 | Purinton | 40/315 |
| 3,249,974 | 5/1966 | Connolly | 24/113 MP |

*Primary Examiner*—Victor N. Sakran

*Attorney, Agent, or Firm*—Hill, Van Santen, Steadman & Simpson

[57] ABSTRACT

A button for attachment to a sheet of compliant material that includes an elastic body and a cap formed from malleable material secured to the body. The flange of the elastic body has an integral thin ring to which the outer portion of the cap is wrapped around and secured. Heat causes expansion of the elastic body; but, because, the ring is thin there is little expansion and the periphery of the cap is not cammed open to become loose on the body of the button.

5 Claims, 1 Drawing Sheet

FIG. 1
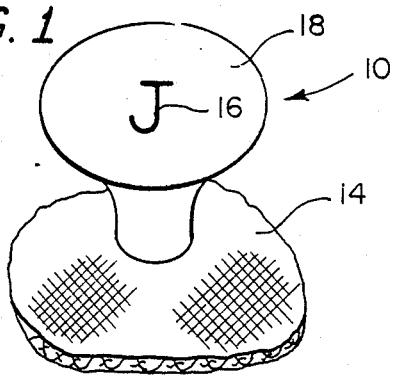
FIG. 8
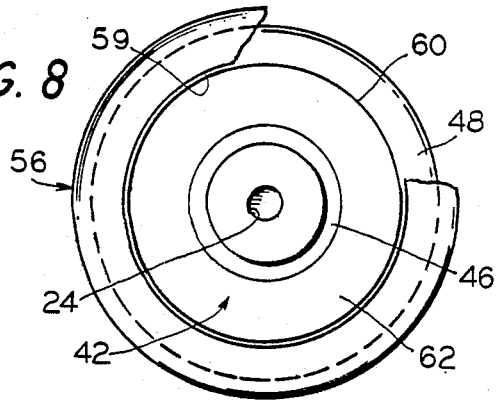
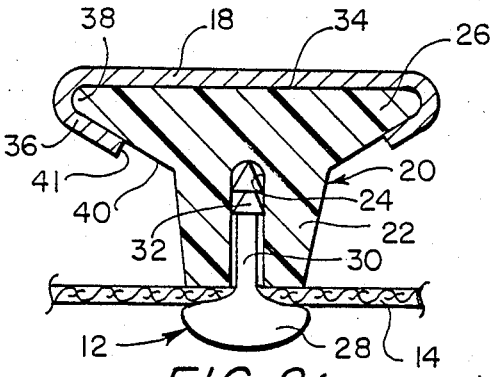
FIG. 2 (PRIOR ART)
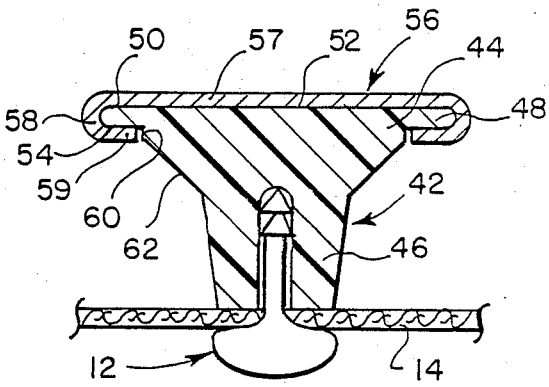
FIG. 5
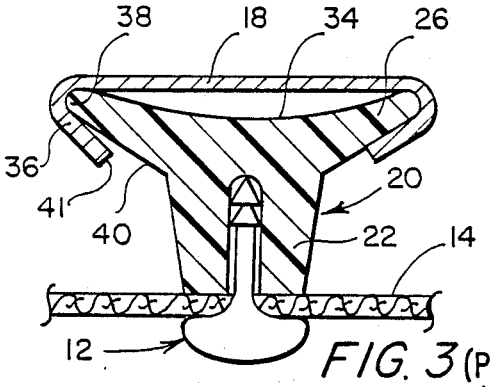
FIG. 3 (PRIOR ART)
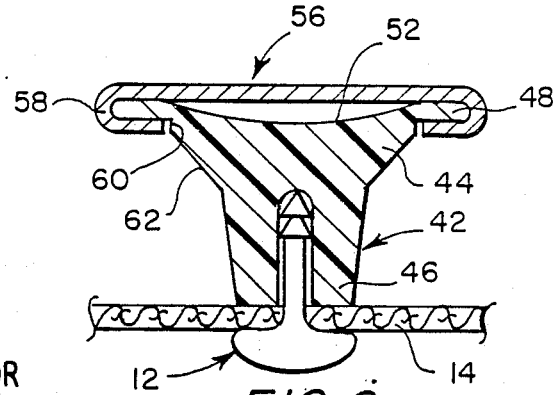
FIG. 6
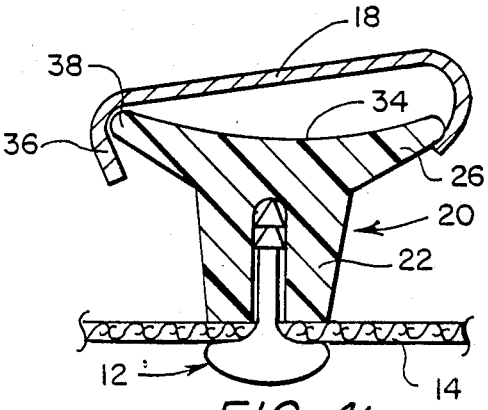
FIG. 4 (PRIOR ART)
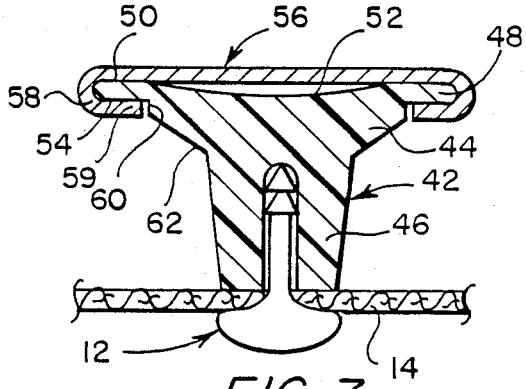
FIG. 7

EXPANSION COMPENSATING TWO PIECE BUTTON

BACKGROUND OF INVENTION

1. Field of Invention

The invention relates to a button having a metal cap and a plastic collet that maintain their engagement and orientation after being subjected to heating and cooling cycles.

2. Description of the Prior Art

Buttons having a plastic collet and a metal cap are popular and in wide use on work clothing as well as designer garments. The metal cap is permanently secured to the plastic collet at manufacture and serves both a utilitarian function as well as the ornamental decorative part of the button. It is essential that the cap be retained on the collet and in its oriented position under all conditions, and particularly after the article is cleaned at which time the button is exposed to high temperatures in both the washing and drying cycles.

The prior art, as exemplified by U.S. Pat. No. 2,332,578 discloses a button having a plastic body with a metal cap interfitted to the body in such a manner that the cap will be prevented from twisting with respect to the body. A curved peripheral edge of the cap partially encompasses the edge of the body to retain the cap on the body, but will be ineffective when the plastic body is exposed to heating and cooling cycles.

As described hereinafter, the button of the subject invention is constructed with a plastic collet and metal cap that can withstand heating and cooling cycles which would destroy the integrity of buttons now available in the marketplace.

SUMMARY OF THE INVENTION

The invention is summarized as a button that can be applied to compliant sheet material subjected to heating and cooling cycles having a collet formed of a plastic material that expands when subjected to heat, the collet includes an upwardly extending shank member having an outwardly extending plate-like flange member surrounding the upper end of the shank member with a peripheral outer ring of reduced thickness circumventing the flange member and a cap of malleable material secured to the flange member with the outer peripheral portion of the cap wrapped about the ring to capture and retain the ring to the flange whereby expansion in volume of the ring upon exposure to heat does not cam open the peripheral portion of the cap and the cap is tightly retained on the flange of the collet.

An object of this invention is to construct a button having a plastic collet and a cap constructed of a malleable material secured thereto with the cap maintaining engagement and orientation after the button is subjected to heating and cooling cycles.

Another object of this invention is a button structure that utilizes a minimum number of elements.

Other objects, advantages and features of the invention will be apparent from the following description of the preferred embodiments taken in conjunction with the accompanying drawings.

BRIEF DESCRIPTION OF THE DRAWINGS

FIG. 1 is a perspective view of the button embodying the present secured to a sheet of compliant material;

FIG. 2 is a vertical cross sectional view of a conventional button attached to compliant material;

FIG. 3 is a view similar to FIG. 2 of the button during exposure of the and button to heat;

FIG. 4 is a view of the button of FIG. 3 after repeated exposure to and cooling;

FIG. 5 is a vertical cross sectional view of the improved button attached material;

FIG. 6 is a view similar to FIG. 5 of the improved button during exposure material and button to heat; and, FIG. 7 is a view of the improved button after repeated exposure to heating and cooling.

FIG. 8 is a bottom elevational view of the bottom o FIGS. 5–7 with a portion of the cap removed.

DESCRIPTION OF THE PREFERRED EMBODIMENT

As illustrated in the drawings, a button 10 is secured by a rivet 12 to a sheet of compliant material such as a fabric 14. Rivet 12 is illustrative only as other means for attaching the button to fabric 14 can be used.

Indicia 16 on the cap 18 of the button is oriented so that when button 10 and rivet 12 are secured together, indicia 16 will lie in and be viewed on a fixed axis. One embodiment showing the structure and apparatus for assembling a button and rivet together with compliant material positioned therebetween is shown and described in the patent to Schmidt, et al, U.S. Pat. No. 3,803,698.

In FIG. 2, there is shown a conventional button body or collet 20, formed of a plastic material such as a synthetic polymer resin, that includes a shank member 22 having a recess 24 and an upwardly flaring plate-like flange member 26. Rivet 12 includes an integrally formed head 28 and a serrated shank 30 with the point 32 of shank 30 adapted to pierce compliant material 14 after which rivet 12 enters and is seated in recess 24 of collet 20.

Cap 18, formed of a malleable material such as sheet metal, covers the flat upper surface 34 of flange 26, with the peripheral portion 36 crimped or turned down to secure cap 18 to the curved peripheral outer edge 38 of flange 26. The lower surface 40 of flange 26 is tapered from outer edge 38 to where it joins shank 22 of collet 20. Flange 26 has a relatively flat upper surface 34 but it becomes progressively thicker as it extends from outer edge 38 to shank 22. Edge 41 of peripheral portion 36 is exposed on lower surface 40 and is objectionable to touch and sight.

The improved button is shown in FIG. 5 with the same reference numerals used for identical components. The improved button has a plastic collet 42 that includes flange 44 and shank member 46 and is secured to compliant material 14 by a rivet 12 in a manner similar to that shown in FIG. 2. Flange 44 has an outer peripheral ring 48 which has an upper surface 50, that is an extension of upper surface 52 of flange 44, and a lower surface 54, with surfaces 50 and 54 located in planes substantially parallel to each other whereby ring 48 is relatively thin in cross section. Cap 56, formed of a malleable material such as sheet metal, has a central portion 57 that contacts flat upper surface 52 of flange 44 with its curved peripheral portion 58 crimped or turned under to engage and cover lower surface 54 so that peripheral portion 58 substantially encloses ring 48 of flange 44 to secure cap 56 thereto. Remote end 59 of peripheral portion 50 is seated in undercut 60 formed in flange 44. The height of undercut 60 is approximately of the same dimension as the thickness of the malleable material of cap 56 to obtain a substantially continuous smooth surface between peripheral portion 58 and lower surface 62 of flange 44. Lower surface 62 of flange 44 is tapered from the lower edge of undercut 60 to shank 46 of collet 42.

After the button is in place on material 14 of an article, such as a garment, it becomes necessary to occasionally wash the garment in warm or hot water, after which it is subjected to high temperature heat in the drying cycle.

As shown in FIGS. 2, 3, and 4, because of the larger mass and greater coefficient of thermal expansion of plastic collet 20 as compared to the mass and coefficient of thermal expansion of metal cap 18, the exposure of button 10 to high temperature heat causes plastic collet 20 to greatly expand in volume thus extending itself along each of its three dimensional axes. Flange 26 of collet 20 expands along its horizontal as well as its vertical axis, as viewed in FIG. 3, but curved peripheral edge 36 of cap 18 prevents any horizontal expansion and cap 18 prevents any vertical expansion. To relieve the resulting pressure, shank 22 of collet 20 is displaced downward in a manner such that upper surface 34 of flange 26 is now separated from the flat under surface of cap 18. This movement is generally referred to as "cupping."

Simultaneously, flange 26 will expand and aided by the cupping action of collet 20, that portion of flange 26 generally referred to as curved outer edge 38 over which peripheral portion 36 of cap 18 is crimped will exert pressure to thereby cam open peripheral portion 36 of cap 18.

Repeated exposure to high heating and cooling cycles will progressively displace peripheral portion 36 of cap 18 from the outer edge 38 of flange 26 such that, as shown in FIG. 4, collet 20 will be deformed and cap 18 will either become loose and turn on flange 26 of collet 20 or eventually fall off, both results being undesirable.

The button of FIGS. 5, 6, and 7, and 8 overcomes these deficiencies. Peripheral outer ring 48 circumventing plate-like flange 44 is substantially reduced in size to be smaller in thickness compared to the button of FIGS. 2, 3, and 4, but has a width that will accept curved peripheral portion 58 of cap 56 which is turned inwardly about outer ring 48 and seated within undercut 60 to engage upper surface 50 and lower surface 54 thereof. Because of the reduced mass of ring 48 positioned within the confines of curved peripheral portion 58, peripheral portion 58 is better able to capture ring 48; and, thus the expansion forces generated within outer peripheral ring portion 48 upon exposure to heat will not open portion 58 of cap 56. Plastic collet 42, however, will expand and, as shown in FIG. 6, shank 46 and flange 44 will pivot about undercut 60 and flat upper surface 52 will separate from the under surface of cap 56. Repeated application of heat will not loosen or dislodge outer peripheral ring portion 48 of flange 44 captured by curved peripheral portion 58 of cap 56, altho collet 42 will eventually take the shape as shown in FIG. 7 with upper surface 52 of flange 44 having a slightly cupped configuration under normal conditions. Thus, the integrity of the button is maintained.

Inasmuch as the present invention is subject to many variations, modifications and changes in detail, it is intended that all matter contained in the foregoing description or shown on the accompanying drawings shall be interpreted as illustrative and not in a limiting sense.

What is claimed is:

1. A button for attachment to a sheet of compliant material subject to heating and cooling cycles comprising:

a unitary plastic collet that expands in volume when subjected to heat and includes an upwardly extending shank member, an outwardly extending plate-like flange member surrounding said shank member at one end thereof and a peripheral outer ring of reduced thickness circumventing said flange member; and, a cap of malleable material engaging the upper surface of said flange member and secured to said peripheral outer ring by turning the outer peripheral portion of said cap inwardly about said ring of said flange to capture and retain said ring of said flange therein, wherein expansion in the volume of said ring of said flange upon exposure to heat does not cam open the peripheral portion of said cap turned inwardly about said outer ring of said flange and said cap is retained in position on said flange member of said collet.

2. A button as claimed in claim 1 wherein said outer ring has an upper and lower surface with the upper surface thereof lying in the same plane as the upper surface of said flange member.

3. A button as claimed in claim 2 wherein the lower surface of said outer ring is positioned substantially parallel to said upper surface.

4. A button as claimed in claim 3 wherein said flange of said collet is undercut at the juncture of said ring and said flange to accommodate the free edge of the outer peripheral portion of said cap to present a smooth surface between said cap and said flange.

5. A button for attachment to a sheet of compliant material subject to heating and cooling cycles comprising:

a molded collet of synthetic polymer that expands in volume when subjected to heat including an upwardly extending shank member, an outwardly extending flange member located at one end of said shank member, said shank member having a recess therein to accept a rivet for securing said collet to the sheet of compliant material, said flange member having a lower dish shaped surface that flares outwardly from said shank member and a flat upper surface, a unitary ring member surrounding said flange member having an upper surface in the same plane as the flat upper surface of said flange and a lower surface parallel to said upper surface, an undercut located substantially at the intersection of said lower dish shaped surface of said flange and said lower surface of said ring member, a cap of malleable material having a flat central portion engaging said flat upper surface of said flange member and secured to said peripheral outer ring by turning the outer peripheral portion of said cap inwardly about said ring of said flange to capture and retain said ring of said flange therein, with the edge of said outer peripheral portion of said cap seated within said undercut, whereby expansion in the volume of said collet when heat is applied will not disengage said cap member.

* * * * *